United States Patent [19]

Metzger

[11] 4,069,022

[45] * Jan. 17, 1978

[54] WATER-FREE LIQUID FUEL SLURRY

[75] Inventor: Grant W. Metzger, San Andreas, Calif.

[73] Assignee: Carbonoyl Company, San Francisco, Calif.

[ * ] Notice: The portion of the term of this patent subsequent to Sept. 23, 1992, has been disclaimed.

[21] Appl. No.: 594,393

[22] Filed: July 9, 1975

Related U.S. Application Data

[63] Continuation-in-part of Ser. No. 446,302, Feb. 27, 1974, Pat. No. 3,907,134.

[51] Int. Cl.[2] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 1,390,232 | 9/1921 | Bates | 44/51 |
| 1,431,225 | 10/1922 | Greenstreet | 44/51 |
| 2,118,477 | 5/1938 | Roberts et al. | 44/51 X |
| 2,430,085 | 11/1947 | Spencer | 44/51 X |
| 2,668,757 | 2/1954 | Hansley | 44/51 |
| 3,764,547 | 10/1973 | Schlinger et al. | 44/51 X |
| 3,907,134 | 9/1975 | Metzger | 44/51 |

FOREIGN PATENT DOCUMENTS

| | | | |
|---|---|---|---|
| 438,351 | 11/1935 | United Kingdom | 44/51 |

*Primary Examiner*—Patrick P. Garvin
*Assistant Examiner*—William G. Wright
*Attorney, Agent, or Firm*—Townsend and Townsend

[57] ABSTRACT

A substantially water-free, high solid content, stable and combustible fuel slurry and the method for producing the same are disclosed. The slurry includes about 5 to about 50 weight percent of solid particulate carbonaceous material, such as powdered coal, with substantially the entire balance of the slurry being comprised of liquid hydrocarbon fuel, such as Bunker C (No. 6) fuel oil, a slurry suspension stabilizing agent and a slurry viscosity reducing agent. The slurry viscosity reducing agent is preferably an anionic surfactant, which is added in an amount to reduce the viscosity of the slurry to a pumpable and flowable level without the addition of substantial quantities of water. In the process, the addition of surfactant as the slurry viscosity reducing agent prevents formation of a gel during storage of the slurry.

7 Claims, No Drawings

WATER-FREE LIQUID FUEL SLURRY

CROSS REFERENCE TO RELATED APPLICATIONS

This application is a continuation-in-part of application Ser. No. 446,302, filed Feb. 27, 1974, now U.S. Pat. No. 3,907,134 issued 9/23/75.

BACKGROUND OF THE INVENTION

1. Field of the Invention

The present invention relates, in general, to combustible fuel slurries containing liquid hydrocarbon fuel and particulate carbonaceous material, and more particularly, relates to the control of the viscosity of, the settling of particles from, and the prevention of the formation of gels in such slurries.

2. Description of the Prior Art

The possibility of adding solid particulate carbonaceous material, such as coal, to a liquid hydrocarbon fuel, such as fuel oil, has been studied for many years. In the last 3 years, and particularly during the last year, the importance of reducing the dependency of the world upon natural gas and liquid hydrocarbon fuels for its energy has been dramatically demonstrated.

While not constituting a complete solution to this problem, attempts have been made to add solid particulate carbonaceous material, such as coal, to liquid hydrocarbon fuels, because such particulate carbonaceous materials are known to be far more plentiful than liquid fuels. Accordingly, there is considerable renewed interest in the possibility of extending and/or supplementing liquid fuels with solid fuels.

Most heavy industrial fuel users have equipment which is designed and constructed for the transportation, storage and combustion of liquid fuels, and yet prior solid-liquid slurries, suspensions or emulsions have not been accepted for regular use in conventional equipment. In some instances such equipment has been converted from its original design for burning solid fuels, a trend which many now believe may need to be reversed.

Numerous approaches have been taken to the problem of combining a solid particulate carbonaceous material with a liquid hydrocarbon fuel. One approach is simply to grind the carbonaceous material to colloidal size before introducing it into an oil. This is successful, but the grinding cost involved is prohibitive. It was also soon discovered that oil-coal slurries tended to form gels when heated to usable temperatures upon storage, usually thixotropic gels, which were undesirable as such gels interfered with pumping and burning of the slurries.

Attempts were made, however, to use the gelling phenomenon to hold larger than colloidal size particles in suspension. In U.S. Pat. No. 2,423,913, a gel is formed by holding the heated material for over 90 hours. The gel is then broken down with more oil, with the resulting slurry assertedly being pumpable without the particulate material settling out. This is inherently a very expensive batch process. In U.S. Pat. No. 1,684,125 a soap is added to the oil component in sufficient quantities to form a gel, and the particulate material is then added to the gel, with the gel reportedly being used to prevent settling of the particulate material.

Various materials have also been added to attempt to stabilize the slurry against the settling of the larger than colloidal size particles. In U.S. Pat. No. 2,118,477 starch was employed in an attempt to stabilize the slurry, and in U.S. Pat. No. 1,447,008 coal distillates and lime-rosin are used to prevent settling of the larger slurry particles. Casein, gelatin and rubber have also been employed as suspension stabilizing agents to prevent slurry settling. It has been found, however, that such suspension stabilizing agents must be employed in quantities which undesirably thicken and increase the viscosity of the slurry in order to maintain substantial quantities of particulate material from settling from the slurry. Increasing the slurry viscosity does reduce the settling problem, but is also undesirably decreases the number of uses to which the slurry may be put.

Other attempts to stabilize oil-coal slurries have included the use of cracked fuel oils (U.S. Pat. No. 1,939,587) and the use of a substantial percentage of colloidal size particles to stabilize the non-colloidal size particles (U.S. Pat. NO. 2,590,733).

Finally, aqueous stabilized oil-coal slurries have been evolved for pipeline transportation purposes such as is shown in U.S. Pat. No. 3,210,168. Such slurries, however, achieve a desired low slurry viscosity by the addition of substantial amounts of water which undesirably reduces the BTU value of the slurry. Furthermore, the water content of the slurry can be corrosive to the equipment employed in connection with handling and burning the same.

Accordingly, it is an object of the present invention to provide a combustible fuel slurry in which liquid hydrocarbon fuels are extended by solid carbonaceous particles with the resulting slurry being usable in conventional fuel oil transportation, storage and burning equipment.

It is a further object of the present invention to provide a method for controlling the formation of gels in slurries of liquid hydrocarbons and solid particulate carbonaceous materials and to further control, without the use of water, the viscosity of such slurries.

It is still a further object of the present invention to provide a method for stabilizing the settling of larger particles from the slurry without undesirably increasing the viscosity of the same or creating a gel in the slurry or its components.

Another object of the present invention is to create a new, stable, combustible fuel slurry which will provide energy at a cost competitive with or lower than the cost of energy provided by liquid hydrocarbon fuels.

Still a further object of the present invention is to provide a stable, combustible fuel slurry in which the method of forming the same and constituents are relatively easy and inexpensive.

The present invention has other objects and features of advantage, some of which will become more apparent from and are set forth in detail in the accompanying description hereinafter.

SUMMARY OF THE INVENTION

The substantially water-free, high solid content, stable and combustible fuel slurry of the present invention is comprised, briefly, of about 5 to about 50 weight percent of a solid particulate carbonaceous material with the balance of the slurry including a liquid hydrocarbon fuel, a slurry suspension stabilizing agent and a water-free slurry viscosity reducing agent. The viscosity reducing agent is present in an amount sufficient to maintain the slurry at a viscosity below about 300 seconds Saybolt Universal when the slurry is at a temperature of 175° F. The viscosity reducing agent is preferably a detergent, and the suspension stabilizing agent is preferably starch.

The process for preventing formation of a gel in and controlling the settling and viscosity of the above slurry is briefly comprised of the step of adding to a slurry containing a suspension stabilizing agent, a detergent in an amount sufficient to maintain the viscosity of the slurry below 300 seconds Saybolt Universal when the slurry is at 175° F.

DESCRIPTION OF THE PREFERRED EMBODIMENT

The combustible fuel slurry of the present invention is principally comprised of a solid particulate carbonaceous material and a liquid hydrocarbon fuel. As used herein, "solid particulate carbonaceous material" shall include such materials as bituminous and anthracite coals, coke, petroleum coke, lignite, charcoal, peat, etc., and combinations thereof. The expression "liquid hydrocarbon fuel" as used herein shall include crude and refined hydrocarbon based oils, including without limitation by enumeration petroleum fuel oils, heavy residual oils and crude oils, and the like. More particularly, liquid hydrocarbon fuel oils having a viscosity in the range of about 50 to about 300 seconds Saybolt Universal at 175° F are preferred. Bunker C (No. 6) residual fuel oil is particularly useful in the slurry of the present invention.

I prefer that the particulate carbonaceous material be powdered or pulverised to a size which will enable substantially the entire quantity employed in the slurry to pass through a 200 mesh sieve or screen. While such screening results in relatively small particle sizes, the particles are considerably larger than colloidal sizes, and some particles larger than a 200 mesh screen but less than 100 mesh can be tolerated. The cost of pulverising or grinding coal or the like to a size appreciably below 200 mesh, particularly colloidal size, begins to increase dramatically, which could eliminate the economic advantages of the present slurry. I have found that such additonal grinding does not produce any material advantage in the practice of the present invention.

The fuel oil and particulate carbonaceous material are preferably mixed in metered amounts in a homogenizing unit, such as a tube mill or the like, with enough residence time that the fuel oil is thoroughly mixed with the particles of the carbonaceous material. For most users about 5 weight percent of coal or less is not normally economically interesting, and above 50 weight percent of pulverized coal begins to cause undesirable flow characteristics is the slurry. The range which is most interesting for many users appears to be between about 20 to about 40 weight percent of the particulate carbonaceous material. The fuel oil comprises substantially the balance of the slurry, except for the addition of a small quantity of a suspension stabilizing agent and a small quantity of a slurry viscosity reducing agent. Thus, the oil will normally comprise about 94 to about 49 weight percent of the slurry.

Since the preponderance of the particles contained in the slurry will be above colloidal size, a slurry suspension stabilizing agent is added. One of the most readily available and economical suspension stabilizing agents is starch, and I have found that a small quantity, for example, about 0.05 weight percent, to be adequate for use in the slurry of the present invention. Other suspension stabilizing agents may be employed; however, starch is the most economical and readily available. It should be noted that the small percentage of suspension stabilizing agent added does cause a thickening or increase in the viscosity of the slurry. This thickening is undesirable from the handling viewpoint, even if it is desirable as a method of minimizing the settling of particles.

Thus, the viscosity of the fuel oils normally employed, the presence of the suspension stabilizing agent, and the high solid content of the slurry have a combined effect of increasing the slurry viscosity substantially to the point at which the slurry does not have the necessary flow characteristics for transportation and burning in existing oil burning equipment. Moreover, and very importantly, I have found that such oil-coal slurries will precipitously begin congealing into a gel when heated to a usable temperature after a short period of storage, for example, about 100 hours. This gel makes the slurry very difficult to handle with ordinary oil handling equipment, and accordingly is very undesirable.

I have found that selected non-aqueous slurry viscosity reducing agents can be introduced in small quantities into the coal-oil slurry to reduce and maintain the viscosity of the slurry at desired levels, without causing settling of the slurry. The slurry viscosity reducing agents which can be advantageously used in the slurry of the present invention include anionic surfactants and amino acids. Anionic surfactants include soaps, i.e. sodium and potassium salts of fatty acids of from 12 to 18 carbon atoms, usually 16 to 18 carbon atoms, e.g. stearate and oleate, and detergents, particularly synthetic detergents, including sulfonates, sulfates, phosphonates, and phosphates, as their sodium or potassium, particularly sodium salts. The anionic detergents will generally have an average of from 12 to 20, usually 16 to 18 carbon atoms and may be aliphatic or alkylbenzene, being aliphatically saturated or unsaturated, generally having not more than about one site of ethylenic unsaturation. The surfactants may be used individually or in combination, for example, a sulfonate and a phosphate or phosphonate salt. The mole ratio of sulfonate to phosphodetergent will generally be 2–10:1.

Also lignin liquors may be used which are sodium salts of lignosulfonate.

The detergents are added conveniently as concentrated solutions or dispersions in water, being added prior to or after combining the fuel oil and coal. The amount of water employed will generally not exceed one weight percent of the final slurry.

The viscosity reducing agent should be present in the slurry in an amount of at least about 0.05 weight percent and an amount sufficient to maintain the slurry at a viscosity below about 300 seconds Saybolt Universal when the slurry is at a temperature of about 175° F. Preferably, the slurry viscosity will be between about 50 to about 300 seconds Saybolt Universal. I have found that about 0.10 to about 0.50 weight percent, not including the water carrier, of viscosity reducing agent will be sufficient to control and maintain the slurry viscosity below about 300 seconds for slurries formed from fuel oils as viscous as Bunker C (No. 6). My tests indicate that about 0.20 to about 0.40 weight percent is desirable for most slurries.

When some viscosity reducing agents, such as lignin liquors, are employed, the slurry viscosity is controlled and reduced to the desired level for pumping and burning, but upon storage of such slurries at an elevated temperature, a gel, which is believed to be a thixotropic gel, will form. In applications in which the slurry is to be transported and completely used in less than 90 hours, the use of non-aqueous viscosity reducing agents such as lignin liquors or amino acids are entirely adequate for controlling the slurry viscosity. In other applications, however, the formation of a gel will occur and is not tolerable.

I have additionally found that certain non-aqueous viscosity reducing agents have the further advantage of preventing the formation of gels. More specifically, detergents, effect the desired reduction of the slurry viscosity and further prevent the slurry from gelling.

The effectiveness of detergents in preventing the formation of gels in the slurry is unexpected in light of the prior use of soaps with fuel oils to form gels. Moreover, the use of detergents as a viscosity reducing agent is also unexpected in light of prior teachings that soaps produce thickening of oil-coal slurries when attempted to be employed as suspension stabilizing agents. I have found, however, that a low viscosity, readily pumpable and flowable oil-coal slurry which is stabilized against settling by a suspension stabilizing agent can be produced when a detergent is employed as a viscosity reducing agent, and that the slurry will not gel upon extended heated storage. The slurry is substantially water-free, can be readily burned and can be economically produced.

EXAMPLES

The following examples are given by way of illustration of the combustible fuel slurry of the present invention and the process for controlling the viscosity and formation of gels therein.

EXAMPLE 1

An average western bituminous coal was pulverized to 100 percent passing through a 200 mesh screen. No. 6 (Dunker C) fuel oil was employed as the liquid hydrocarbon fuel. About 60 parts by weight of fuel oil were heated to 175° F, and the pulverized coal and a saturated aqueous solution of starch and a saturated aqueous solution of soap were substantially simultaneously added to the fuel oil. The aqueous solution of starch contained starch in the amount of 0.05 weight percent of the resulting slurry, and the aqueous solution of soap included soap in the amount of 0.28 weight percent of the slurry. About 40 parts by weight of the coal was introduced into the fuel oil, and the slurry was mixed thoroughly. The resulting slurry had a viscosity of about 150 seconds Saybolt Universal at 175° F and could be readily pumped and atomized for burning. Additionally, the slurry was stored at 175° F for 30 days and there was no formation of gel or settling of coal particles.

EXAMPLE 2

The procedure of Example 1 was repeated with the solid carbonaceous material being provided by residual petroleum (delayed) coke which was ground to 100 percent passing a 200 mesh sieve. No. 6 fuel oil was again employed with 0.05 weight percent starch and 0.25 weight percent soap being added in saturated aqueous solution. The resulting slurry had a viscosity of about 145 seconds Saybolt Universal at 175° F, and it could be readily pumped and atomized. The slurry was stored for 30 days and there was no formation of a gel.

EXAMPLE 3

The procedure of Example 1 was again employed with No. 6 fuel oil and pulverized coal. The fuel oil had 0.05 weight percent of starch added thereto and 0.20 weight percent of soap. About 83 parts by weight of the fuel oil were added to about 20 parts by weight of pulverized coal. The resulting slurry had a viscosity of about 110 seconds Saybolt Universal at 175° F and was stored for 30 days without the formation of a gel.

EXAMPLE 4

The slurry of Example 1 was reformulated with 0.28 weight percent of lignin liquor being employed in place of the soap. The resulting slurry had a viscosity of about 168 seconds Saybolt Universal at 175° F and could be readily pumped and atomized. After about 4 days of storage at 175° F, however, the slurry became a firm gel.

EXAMPLE 5

The procedure of Example 1 was again repeated with 0.28 percent of a commercially available detergent used in place of soap as the viscosity reducing agent. The resulting slurry had a viscosity of 142 seconds Saybolt Universal at 175° F and was stored for 30 days at that temperature without the formation of a gel.

EXAMPLE 6

The procedure of Example 1 was again repeated with the starch suspension stabilizing agent omitted. The resulting slurry had a viscosity of about 130 seconds Saybolt Universal at 175° F, but after storage at that temperature for about 3 hours, settling of coal particles was observed.

EXAMPLE 7

The procedure of Example 6 was again repeated with about 2.0 weight percent soap employed instead of 0.28 weight percent. The resulting slurry had a viscosity of about 350 seconds Saybolt Universal at 175° F and upon storage for 8 hours the viscosity increased to about 400 seconds Saybolt Universal at 175° F. Settling of the slurry was also noted.

What is claimed is:

1. A substantially water-free, high solid content, stable and combustible fuel slurry comprising:

about 5 to about 50 weight percent of a solid particulate carbonaceous material, about 94 to about 49 weight percent of a liquid hydrocarbon fuel, a minor slurry suspension stabilizing amount of starch, and a non-aqueous slurry viscosity reducing amount of an anionic surfactant and being present in an amount sufficient to maintain said slurry at a viscosity below about 300 seconds Saybolt Universal when said slurry is at a temperature of about 175° F.

2. A slurry as defined in claim 1, wherein said anionic surfactant is composed at least in part of a salt of an alkyl sulfonate.

3. A slurry as defined in claim 1, wherein said particulate carbonaceous material has a size enabling substantially the entire amount thereof to pass through a 200 mesh sieve, said anionic surfactant is a synthetic sulfonate detergent and is present in an amount of about 0.10 to about 0.50 weight percent, and said starch is present in an amount of at least about 0.05 weight percent.

4. A slurry as defined in claim 3, wherein said liquid hydrocarbon fuel is a fuel oil having a viscosity in the range of about 50 to about 300 seconds Saybolt Universal at 175° F, and said detergent is present in an amount of about 0.20 to about 0.40 weight percent.

5. A slurry according to claim 1, wherein said anionic surfactant consists of at least one member selected from the group consisting of sulfonate, sulfate, phosphonate and phosphate detergents.

6. A slurry according to claim 5, wherein said anionic surfactant is a combination of sulfonate and phosphate detergents.

7. A slurry according to claim 6, wherein said anionic surfactant is present in total amount of from about 0.1 to 0.5 weight percent.

* * * * *